US007539435B2

(12) United States Patent
Katoh et al.

(10) Patent No.: US 7,539,435 B2
(45) Date of Patent: May 26, 2009

(54) IMAGE FORMING APPARATUS WITH ISOLATING MEMBER FOR POWDER DEVELOPER

(75) Inventors: Atsuyuki Katoh, Tenri (JP); Hiroshi Ishii, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 402 days.

(21) Appl. No.: 11/387,028

(22) Filed: Mar. 22, 2006

(65) Prior Publication Data

US 2006/0216055 A1 Sep. 28, 2006

(30) Foreign Application Priority Data

Mar. 25, 2005 (JP) ..... 2005-089857

(51) Int. Cl.
*G03G 21/20* (2006.01)

(52) U.S. Cl. ..... 399/92; 399/93; 399/98; 399/99

(58) Field of Classification Search ..... 399/92, 399/93, 98, 99, 107, 121
See application file for complete search history.

(56) References Cited

U.S. PATENT DOCUMENTS

| | | | | |
|---|---|---|---|---|
| 4,154,521 | A * | 5/1979 | Tanaka | 399/93 |
| 4,178,092 | A * | 12/1979 | Yamamoto et al. | 399/93 |
| 4,727,385 | A * | 2/1988 | Nishikawa et al. | |
| 5,028,959 | A * | 7/1991 | Gooray | 399/93 |
| 5,073,796 | A * | 12/1991 | Suzuki et al. | 399/93 |
| 5,539,500 | A * | 7/1996 | Hamamichi et al. | 399/98 |
| 6,151,466 | A * | 11/2000 | Fujiwara | 399/92 |
| 6,941,089 | B2 * | 9/2005 | Rivera et al. | 399/92 |
| 2004/0052538 | A1 * | 3/2004 | Yugeta et al. | |
| 2007/0041750 | A1 * | 2/2007 | Mizuta | |

FOREIGN PATENT DOCUMENTS

| | | |
|---|---|---|
| JP | 05-019559 | 1/1993 |
| JP | 06-258904 | 9/1994 |
| JP | 08-063019 | 3/1996 |
| JP | 2003-150026 | 5/2003 |
| JP | 2005-099880 | 4/2005 |

* cited by examiner

*Primary Examiner*—David M Gray
*Assistant Examiner*—Laura K Roth
(74) *Attorney, Agent, or Firm*—Renner, Otto, Boisselle & Sklar, LLP

(57) ABSTRACT

An isolating wall is provided for isolating, from a space outside the isolation wall, a space including: a photosensitive drum; a developing unit; a charging device; a transfer device; and a fixing device. With this configuration, the space in which powder toner (toner which is not fixed on a recording material by the fixing device) is present is isolated from the space outside the isolation wall. Thus, in an image forming apparatus using powder developer, this configuration makes it possible to (i) prevent the floating toner from going out of the image forming apparatus, or (ii) prevent the floating toner from deteriorating a function of the image forming apparatus.

12 Claims, 10 Drawing Sheets

IMAGE FORMING APPARATUS WITH ISOLATING MEMBER FOR POWDER DEVELOPER

This Nonprovisional application claims priority under 35 U.S.C. §119(a) on Patent Application No. 089857/2005 filed in Japan on Mar. 25, 2005, the entire contents of which are hereby incorporated by reference.

FIELD OF THE INVENTION

The present invention relates to an image forming apparatus having an electrophotographic recording system or an electrostatic recording system, the image forming apparatus visualizing, by using powder developer, an electrostatic latent image formed on a photoreceptor.

BACKGROUND OF THE INVENTION

Conventionally, an electrophotographic image forming apparatus has been widely used as an image forming apparatus such as a copying machine, a printer, or a facsimile device.

In the electrophotographic image forming apparatus, a charging device electrically charges a photosensitive surface of a photosensitive drum. The electrically charged photosensitive surface is then subjected to an exposure process using an exposure device, so that an electrostatic latent image is formed on the photosensitive surface of the photosensitive drum. Then, a developing device develops the electrostatic latent image having been formed, so as to form a toner image (visible image) on the photosensitive surface. After this toner image is transferred to a sheet (recording material such as paper, OHP (Overhead Projector) recording paper, etc.) by a transfer device, the toner image is fixed by using a fixing device.

The fixing device fixes toner on a recording medium such as recording paper by applying heat and pressure on the recording medium. In general, a fixing device having a fixing (heating) roller and a pressure roller is widely used. Here, this type of fixing device is referred to as a pair-roller fixing device. In the pair-roller fixing device, a sheet having thereon an unfixed toner image is transferred through a nip region between the fixing and pressure rollers, thereby fixing the unfixed toner image on the sheet.

Incidentally, if the heat from the fixing device is not exhausted out of the image forming apparatus, the heat built up in the image forming apparatus would give a negative effect to other devices in the image forming apparatus. In view of that problem, an exhaust fan is often provided, for the purpose of discharging the heat in the image forming apparatus. For example, Japanese Unexamined Patent Publication No. 150026/2003 (Tokukai 2003-150026; published on May 21, 2003) discloses an image forming apparatus including an expansible silencer is provide in an air-blowing path for a heat-discharging fan, for the purpose of reducing noise produced by the heat-discharging fan.

Further, Japanese Unexamined Patent Publication No. 258904/1994 (Tokukaihei 6-258904; published on Sep. 16, 1994) discloses a technology which (i) reduces a necessary cooling ability that a fan should have; or (ii) eliminating the need of a fan itself. In order to achieve this, the technology uses a temperature adjusting device which absorbs heat from a high temperature part in the main body of the image forming apparatus, and discharges the absorbed heat to a low-temperature part.

Further, Japanese Unexamined Patent Publication No. 63019/1996 (Tokukaihei 8-63019; published on Mar. 26, 1996) discloses a configuration in which a pressure roller is surrounded by a thermal conductor whose surface (inner surface) facing toward the pressure has a higher heat absorption coefficient than a surface (outer surface) opposite thereto. In this configuration, the inner surface of the heat conductive member has a higher heat absorption coefficient, so that the inner surface of the heat conductive member absorbs the heat from the pressure roller, and evenly distributes the heat through out the thermal conductor. The heat evenly distributed through out the thermal conductor is then radiated to the pressure roller. Further, the outer surface of the heat conductive member has a smaller heat absorption coefficient. This restrains the heat generated by the pressure roller from being dissipated out of the image forming device. In this way, the configuration disclosed in Tokukaihei 8-63019 (i) efficiently utilizes the heat; (ii) restrains an increase in an internal temperature in the device; and (iii) reducing a necessary ability that an heat-discharging fan should have.

However, the above conventional technology causes the following problems when applied to an image forming apparatus in which powder developer (toner) is used for visualizing the electrostatic latent image being formed on a photoreceptor by an electrophotographic recording method or an electrostatic recording method, which is provided with a venting-out fan for venting, to the outside, the heat in the image forming apparatus. Namely, toner floating in an image forming apparatus will be dissipated into the surrounding environment, whereby the environment surrounding the image forming apparatus gets dirty with the toner.

Particularly, in recent years, a particle diameter of toner has been reduced for the purpose of improving a quality of an image, and a printing speed has been accelerated. This makes it easier to cause dispersing or floating the toner in the image forming apparatus. Thus, the floating toner contained in the discharged air from the image forming apparatus is particularly becoming an issue.

Further, the foregoing Tokukaihei 6-258904 describes that the use of the fan itself is eliminated by providing the temperature adjusting device for discharging the heat in the high temperature portion of the image forming apparatus to the low temperature portion. However, if the heat in the high temperature part is not sufficiently discharged, there is a possibility that the internal temperature of the apparatus increases, and negatively affects the members in the image forming apparatus. Further, even if the apparatus is not provided with a fan, the toner floating in the apparatus may be let out of the apparatus through a recording material transporting path or the like. Further, even if it is possible to eliminate the need for a fan, the floating toner in the image apparatus may adhere to an optical element or the like of an exposure device. This deteriorates an image quality.

SUMMARY OF THE INVENTION

The present invention was made in view of the foregoing problems, and it is an object of the present invention to arrange an image forming apparatus using powder developer such that (i) the floating toner will not be let out of the image forming apparatus, or (ii) the floating toner is prevented from deteriorating a function of the image forming apparatus.

In order to solve the foregoing problems, an image forming apparatus of the present invention includes: a photoreceptor for forming an electrostatic latent image thereon; a developing device for visualizing, by using powder developer, the electrostatic latent image formed on the photoreceptor; a transfer device for transferring, onto a recording material, an image visualized by the developing device; a fixing device for fixing the powder developer on the recording material by heating and melting the powder developer; and an isolating member for isolating a first space from a second space, the first space being a space in which the powder developer which is not yet fixed on the recording material is present, and the second space being a space outside the isolating member.

With this configuration, it is possible to isolate, from the outside space (second space), the space (first space) in which the powder developer which is not fixed on the recording material is present. This prevents the floating powder developer from going outside of the isolating member, even if the unfixed powder developer floats inside the image forming apparatus. As such, it is possible to keep the floating powder developer inside the image forming apparatus; and (ii) prevent the floating powder developer from adhering on a member provided outside the isolating member. As a result, it is possible to avoid getting dirty an environment surrounding the image forming apparatus with the floating toner and/or deterioration of function of the image forming apparatus.

Additional objects, features, and strengths of the present invention will be made clear by the description below. Further, the advantages of the present invention will be evident from the following explanation in reference to the drawings.

BRIEF DESCRIPTION OF THE DRAWINGS

FIG. 11(*b*) is an explanatory diagram illustrating a configuration of the heat pump illustrated in FIG. 11(*a*).

DESCRIPTION OF THE EMBODIMENTS

Embodiment 1

Figure 1:
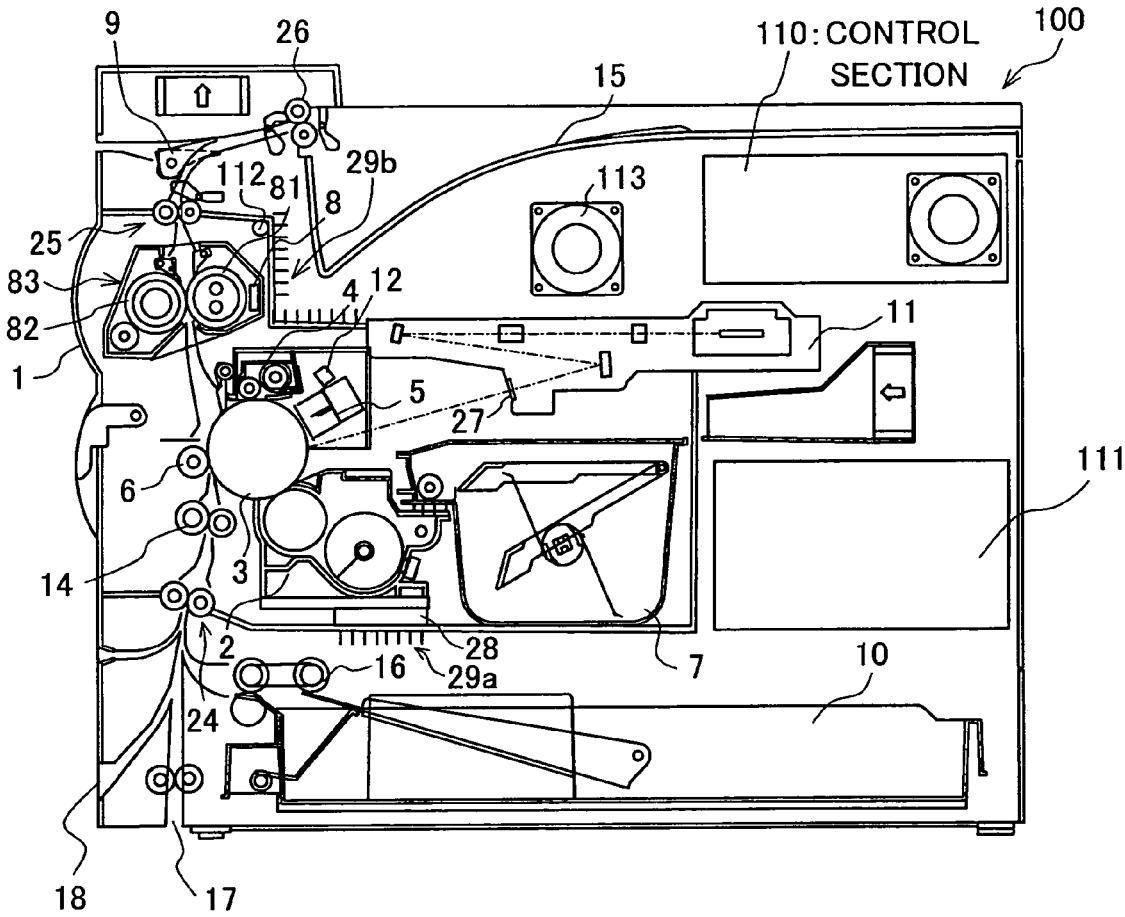
FIG. 1 is a cross sectional view illustrating an image forming apparatus of an embodiment, in accordance with the present invention.

The following describes an embodiment of the present invention. FIG. 1 is a cross sectional view of an image forming apparatus 100 in accordance with the present invention. The image forming apparatus 100 forms an image, by using two-component developer which includes toner (powder developer) and a carrier. Further, the image forming apparatus 100 forms an image on a sheet (recording material), based on image data received from an external device.

As illustrated in FIG. 1, the image forming apparatus 100 includes processing units playing their respective roles in an image forming process. Such processing units are: a photosensitive drum 3; a charging device 5; an optical scanning unit 11; a developing unit 2; a transfer device 6; a cleaning unit 4; a discharge lamp 12; a fixing device 8; and the like. Note that the charging device 5, the optical scanning unit (exposure device, exposure optical system) 11, the developing unit 2, the transfer device 6, the cleaning unit 4, and the discharge lamp 12 are arranged around the photosensitive drum 3 in this order.

Further, the image forming apparatus 100 includes an isolating wall (isolating member) 1 which: (i) surrounds a space (first space; hereinafter inside or interior space of the isolation wall 1) the photosensitive drum 3, the charging device 5, the developing unit 2, the transfer device 6, the cleaning unit 4, the discharge lamp 12, and the fixing device 8; and (ii) isolates (shields) these members from the exterior space (second space; hereinafter outside or exterior space of the isolating wall 1). With this configuration, floating toner in the image forming apparatus 100 is prevented from going outside of the image forming apparatus 100 (that is, kept inside the image forming apparatus 100). The isolating wall 1 is described in detail later.

The charging device 5 evenly charges a surface of the photosensitive drum 3, so that the optical scanning unit 11 is able to form an electrostatic latent image on the photosensitive drum 3. The charging device 5 is described in detail later.

The optical scanning unit (exposure device) 11 scans the photosensitive drum 3 with a laser beam (i.e. exposes the photosensitive drum 3) in accordance with image data received from an external device, or image data having been read by an image reading apparatus 30, so as to form an electrostatic latent image on the evenly charged surface of the photosensitive drum 3.

The developing unit 2 forms a toner image on a photosensitive drum 3. Specifically, by using the toner supplied from a toner supplying container 7, the developing unit 2 visualizes the electrostatic latent image formed on the photosensitive drum 3 by the optical scanning unit 11. The developing unit 2 is described in detail later.

The transfer device 6 carries out a process (electrostatic transfer process) for transferring, onto a sheet (recording material), the toner image visualized on the photosensitive drum 3.

The cleaning unit 4 removes toner remained on the photosensitive drum 3, so that an electrostatic latent image and a toner image can be newly recorded on the photosensitive drum 3. Furthermore, the discharge lamp 12 is for electrically discharging the surface of the photosensitive drum 3.

The fixing device 8 fixes the toner image having been transferred onto the sheet. The fixing device 8 includes a fixing roller (heating roller) 81 and a pressure roller 82. Sheets on which a toner image has been transferred by the transfer device 6 are subsequently sent to the fixing device 8. The sheets are subsequently passed between the fixing roller 81 and the pressure roller 82. While a sheet is passing therebetween, a heat and a pressure is applied to the sheet so as to fix the toner image (developed image) transferred on the sheet. Through the process, an image is recorded on the sheet.

Figure 2:
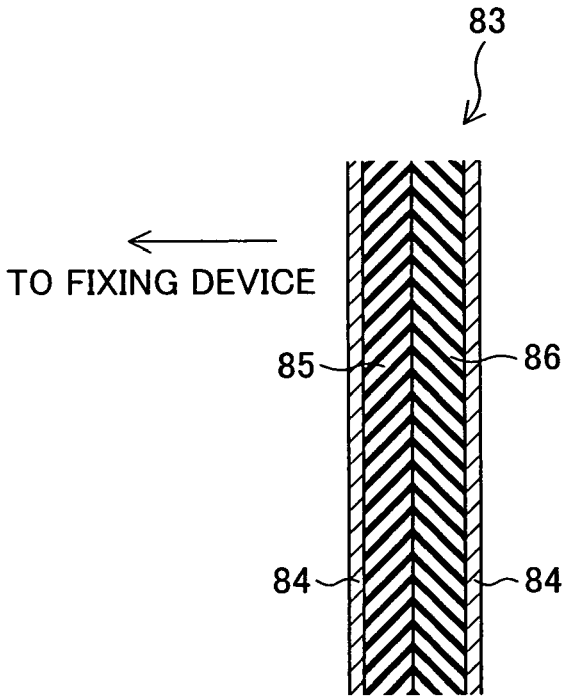
FIG. 2 is a cross sectional view illustrating an exemplary configuration of a heat insulating wall which is provided around a fixing device in the image forming apparatus of the embodiment in accordance with the present invention.

Further, as illustrated in FIG. 1, an heat insulating wall (heat insulating member, vacuum heat insulating member) 83 is provided around the fixing device 8. FIG. 2 is a cross sectional view illustrating a configuration of the heat insulating wall 83. As illustrated, the heat insulating wall 83 has exterior walls (outer members) 84 interposing therebetween a first layer (spacer material) 85 and a second layer (spacer material) 86. The exterior walls 84 are tightly sealed so that a region between the exterior walls 84 is in the vacuum state. For example, the first layer 85 is made of inorganic fine powder, such as silica, pearlite, calcium silicate, or diatom earth. The first and second layers 85 and 86 are provided in this order from the position of the fixing device 8. Further, for example, the spacer material 86 is made of an open-cell urethane foam. Note that the spacer material 86 is not limited to this, and the spacer material may be made of an organic substance or an inorganic substance. However, it is preferable that the spacer material 86 be made of a foam material whose bubble diameter is sufficiently small, the foam material having entirely opened-cell structure.

Further, a supply tray 10 is provided at a bottom portion of the image forming apparatus 100. This supply tray 10 is provided inside the main casing of the image forming apparatus.

The supply tray 10 serves as a recording material holding tray for holding thereon sheets (recording material). The sheets held on the supply tray 10 are picked up one by one, by a pickup roller 16 or the like. Each of the sheets is fed to resist rollers 14, via transporting rollers (transporting member) 24. Then, the resist roller 14 supplies each of the sheet to a nip between the photosensitive drum 3 and the transfer device, at such a timing that the toner image formed on the photosensitive drum 3 is transferred onto a predetermined position of the sheet. Thus, the toner image which is formed on the photosensitive drum 3 is transferred onto the sheet. When replenishing the sheets on the supply tray 10, the supply tray 10 is drawn out from the image forming apparatus 100 frontward (in a direction of operation side).

Further, the sheet on which the toner image is fixed by the fixing device 8 (i.e. the sheet on which an image is recorded) is further transported by transporting rollers (transporting members) 25, and passes a switching gate 9. If it is set so that a sheet is outputted to an output-sheet receiving tray 15 which is provided outside the image forming apparatus 100, the sheet is outputted to the output-sheet receiving tray 15 through reverse rollers 26.

Further, the image forming apparatus 100 includes a control section 110 which includes, for example: (a) a circuit board (not shown) for controlling an operation of each members of the image forming apparatus 100; and (b) an interface circuit (not shown) for accepting image data from an external device. The interface is for performing a wireless or wired communication with an external device such as a personal computer or a facsimile device. With the provision of the interface circuit, the image forming apparatus 100 is able to record, on the sheet, an image based on data received from an external device.

Further, the image forming apparatus 100 includes a power supply device 111 for supplying power to each member of the image forming apparatus 100.

Next, an isolating wall 1 is described in detail. As illustrated in FIG. 1, the isolating wall 1 surrounds: the photosensitive drum 3; the charging device 5; the developing unit 2; the transfer device 6; the cleaning unit 4; the discharge lamp 12; and the fixing device 8. This isolating wall 1 is provided so that these members are shielded from the exterior space of the isolating wall 1. The material of which the isolating wall 1 is made is not particularly limited. However, in order to effectively dissipate the heat from the internal space to the exterior space of the isolating wall 1, it is preferable that the material have a large heat conductivity. Further, for example, for carrying out maintenance work on the members surrounded by the isolating wall 1, or for dealing with a jam occurred in transportation inside the isolating wall 1, the isolating wall 1 is configured such that the isolating wall 1 can be opened so that the area inside the wall can be exposed.

Figure 3:
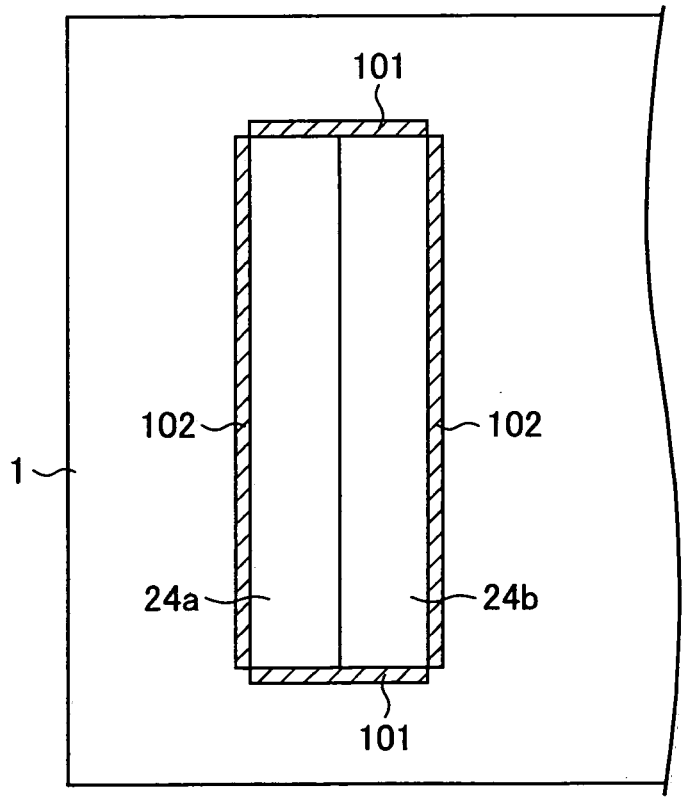
FIG. 3 is a plane view illustrating an isolating wall and a transporting roller in the image forming apparatus of the embodiment in accordance with the present invention.

FIG. 3 is a plane view illustrating the transporting rollers 24 and the isolating wall 1, each of which being viewed from the upstream side of the sheet transportation direction. As illustrated in the figure, the transporting rollers 24 includes two rollers 24*a* and 24*b* which are provided so that the roller 24*a* and 24*b* abut each other. These rollers 24*a* and 24*b* rotate in opposite direction to each other, so as to transport the sheet sandwiched therebetween.

Further, in a gap between (i) the isolating wall 1 and (ii) each end portion of the rollers 24*a* and 24*b* in a direction of their rotation axes (i.e., longitudinal direction), a seal member 101 which is made of felt is provided. Further, a seal member 102 is provided in a gap between (i) the isolating wall 1 and (ii) each side face of the rollers 24*a* and 24*b* (each surface, of the both rollers, opposite to the side where the both rollers abut each other). This seal member 102 is made of a flexible material such as polyethylene terephthalate film (e.g. Myler Film (product name; E. I. du Pont de Nemours and Co.) or the like. The seal members 101 and 102 are arranged so that the transporting rollers 24*a* and 24*b* slides on the seal member 101 and 102.

Note that the above description only discusses the seal members 101 and 102 provided in the gaps between the transporting roller 24 and the isolation wall 1. However, a similar seal member is provided in a gap between the transporting rollers 25 and the isolating wall 1.

Further, a transparent cover member (cover glass) 27 made of transparent glass or the like is provided in a part of the isolating wall 1, so that a laser beam from the optical scanning unit 11 passes through the transparent cover member 27 and reaches the photosensitive drum 3. The optical scanning unit 11 is provided outside of the isolating wall 1 and the transparent cover member 27 is located therebetween. Note that the transparent cover member 27 may be a part of the isolating wall 1. Alternatively, the transparent cover member 27 may be provided to the optical scanning unit 11 in such a way that the transparent cover member 27 is, for example, attached to/fit in an opening formed on the isolating wall 1.

Further, the isolating wall 1 is provided with a heat dissipating fin (heat dissipating member) 29*a* on an outside surface thereof below the developing unit 2. Further, a heat conductive member 28, which is made of a material (e.g.

aluminium) whose heat conductivity is large, is sandwiched between the developing unit 2 and the isolating wall 1.

Further, the isolating wall 1 is provided with a heat dissipating fin (heat dissipating member) 29*b* on the outside surface thereof beside the fixing device 8. This heat dissipating fin 29*b* is for facilitating exchanging of heat between inside and outside the isolating wall 1. Further, the image forming apparatus 100 includes a fan (ventilating device) 113. By using this fan 113, the heat which has been dissipated to the outside of the isolating wall 1 by using the heat dissipating fin 29*b* is dissipated to the outside of the image forming apparatus 100.

Further, that surface of the isolating wall 1, which is above the fixing device 8 is tilted down towards the heat dissipating fin 29*b*. Further, below a lower end portion of the tilted surface, a drain hole (outlet hole) 112 is provided in the vicinity of the heat dissipating fin 29*b*. With this drain hole 112, the moisture inside the isolating wall 1 is sent to the vicinity of the heat dissipating fin 29*b* provided outside the isolating wall 1. Furthermore, the drain hole 112 is provided with a filter (second developer removing device; not shown) for preventing the toner from going outside the isolating wall 1. With the drain hole 112, a pressure inside the isolating wall 1 and that outside the isolating wall 1 are kept even.

Figure 4:
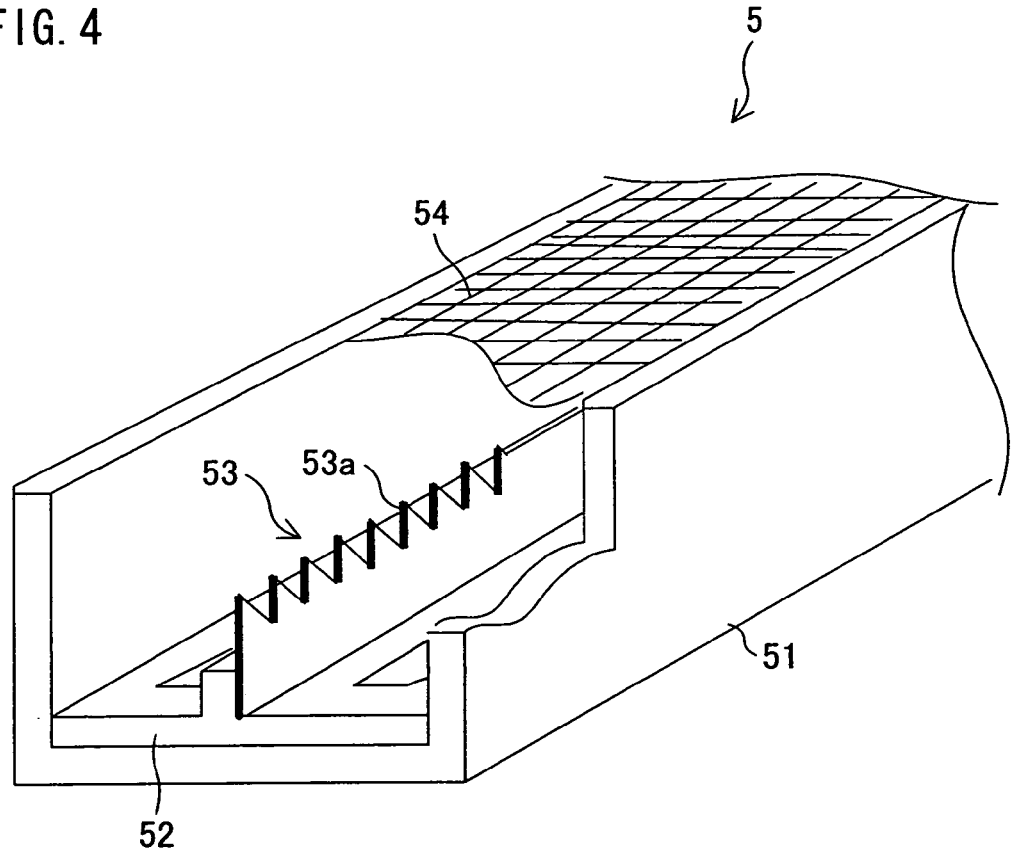
FIG. 4 is a perspective view illustrating a part of a charging device provided in the image forming apparatus of the embodiment in accordance with the present invention.
Figure 5:
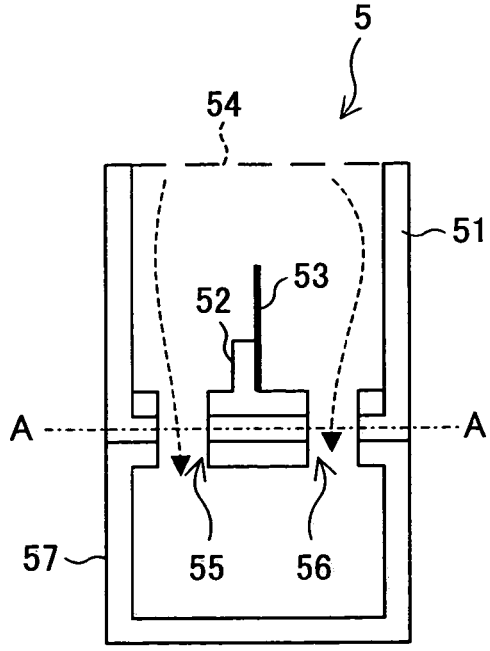
FIG. 5 is a cross sectional view illustrating a charging device in the image forming apparatus of the embodiment, in accordance with the present invention.
Figure 6A:
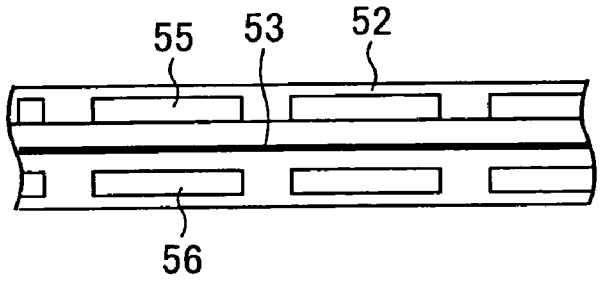
FIG. 6(*a*) and FIG. 6(*b*) are respectively cross sectional views illustrating part of the charging device in the image forming apparatus of the embodiment, in accordance with the present invention.
Figure 6B:
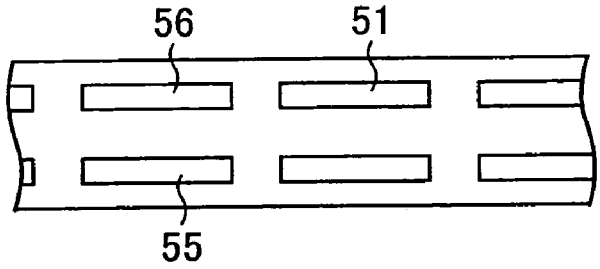
Figure 7:
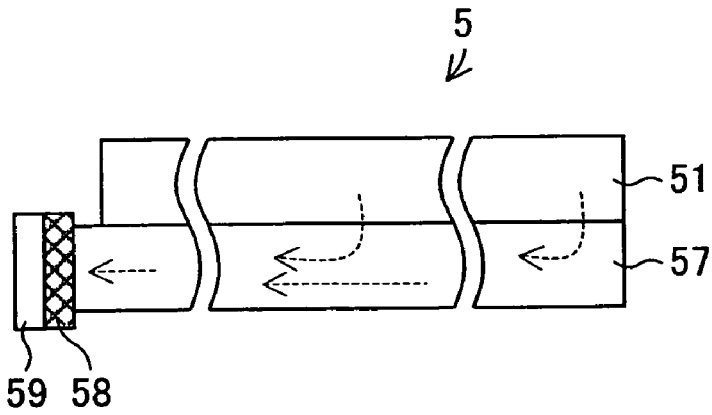
FIG. 7 is a view illustrating part of the charging device in the image forming apparatus of the embodiment, in accordance with the present invention.

Next, the following describes in detail the charging device 5 in the image forming apparatus 100. FIG. 4 is a perspective view of the charging device 5. Further, FIG. 5 is a cross sectional view of the charging device 5. Further, FIG. 6(*a*) is a cross sectional view taken along line A-A in FIG. 5, and is illustrating the charging device 5 viewed from the photosensitive drum 3. FIG. 6(*b*) is a cross sectional view taken along line A-A in FIG. 5, and is illustrating the charging device 5 viewed from an opposite side of FIG. 6(*a*). FIG. 7 is a plane view illustrating the charging device 5 viewed from a side of the charging device 5.

As illustrated in FIG. 4, the charging device 5 includes: a casing 51; a supporting member 52; sawtooth electrode (discharge electrode) 53; and a grid electrode 54.

The sawtooth electrode 53 is so-called charging electrode which discharges upon application of a voltage. The sawtooth electrode 53 includes a plurality of discharge electrodes 53*a*, each having a sharp-projection shape. These discharge electrodes 53*a* are aligned in a certain direction, thus forming a sawtooth-like shape. Further, the sawtooth electrode 53 is supported by the supporting member 52 in the casing 51 so that, when the charging device 5 is arranged in the image forming apparatus 100, the respective leading edges (point portions) of the discharge electrodes 53*a* are directed towards the photosensitive drum 3. To this sawtooth electrode 53, a voltage from a high-voltage power supply (not shown) is applied, so that corona discharge occurs between the sawtooth electrode 53 and the photosensitive drum 3.

An aperture section is formed on such a part of the casing 51 that the aperture section faces the photosensitive drum 3 when the charging device 5 is arranged in the image forming apparatus 100. That is, the aperture section is formed so that the point portions of the respective discharge electrodes 53*a* are directed towards the aperture section. The grid electrode 54 is formed in this aperture section.

The grid electrode 54 is wire meshes serving as an electrode. This grid electrode 54 is connected to another power supply (not shown) which is not the high-voltage power supply connected to the sawtooth electrode 53. From the other power supply, a bias voltage (grid voltage) is applied to the grid electrode 54. With the application of the grid voltage, the grid electrode 54 controls a corona ion stream, so as to adjust an amount of ions reaching the photosensitive drum 3.

Further, as illustrated in FIG. 5, the casing 51 is provided with a duct 57. The duct 57 is provided on that side of the casing 51 which faces the grid electrode 54. Apertures 55 and 56 are formed, which passes to the duct 57 through the casing 51 and the supporting member 52 (See FIGS. 5, 6(*a*), and 6(*b*)).

As illustrated in FIG. 7, one end of the duct 57 in a lengthwise direction is blocked, and another end of the duct 57 is provided with an ozone filter (ozone removing device) 58 and a fan 59(first suction device).

The ozone filter 58 is for absorbing (adsorbing) ozone which is a corona product as a result of discharging in the charging device 5. For example, the ozone filter 58 is an activated-carbon type ozone filter (e.g. KF Honeycomb Ozone Filter (product name) produced by Toyobo Ltd.).

The fan 59 sucks in the air in the duct 57, and vents the air out of the charging device 5 through the ozone filter 58. Thus, as indicated by the dotted arrow in FIG. 5 and FIG. 7, the air is sucked into the casing 51 from the aperture (in which the grid electrode 54 is provided) opened toward the photosensitive drum 3. The air being sucked in flows into the duct 57 via the vicinity of the sawtooth electrode 53. Then, after the ozone in the air is absorbed and removed by the ozone filter 58, the air is vented out of the charging device 5.

Figure 8:
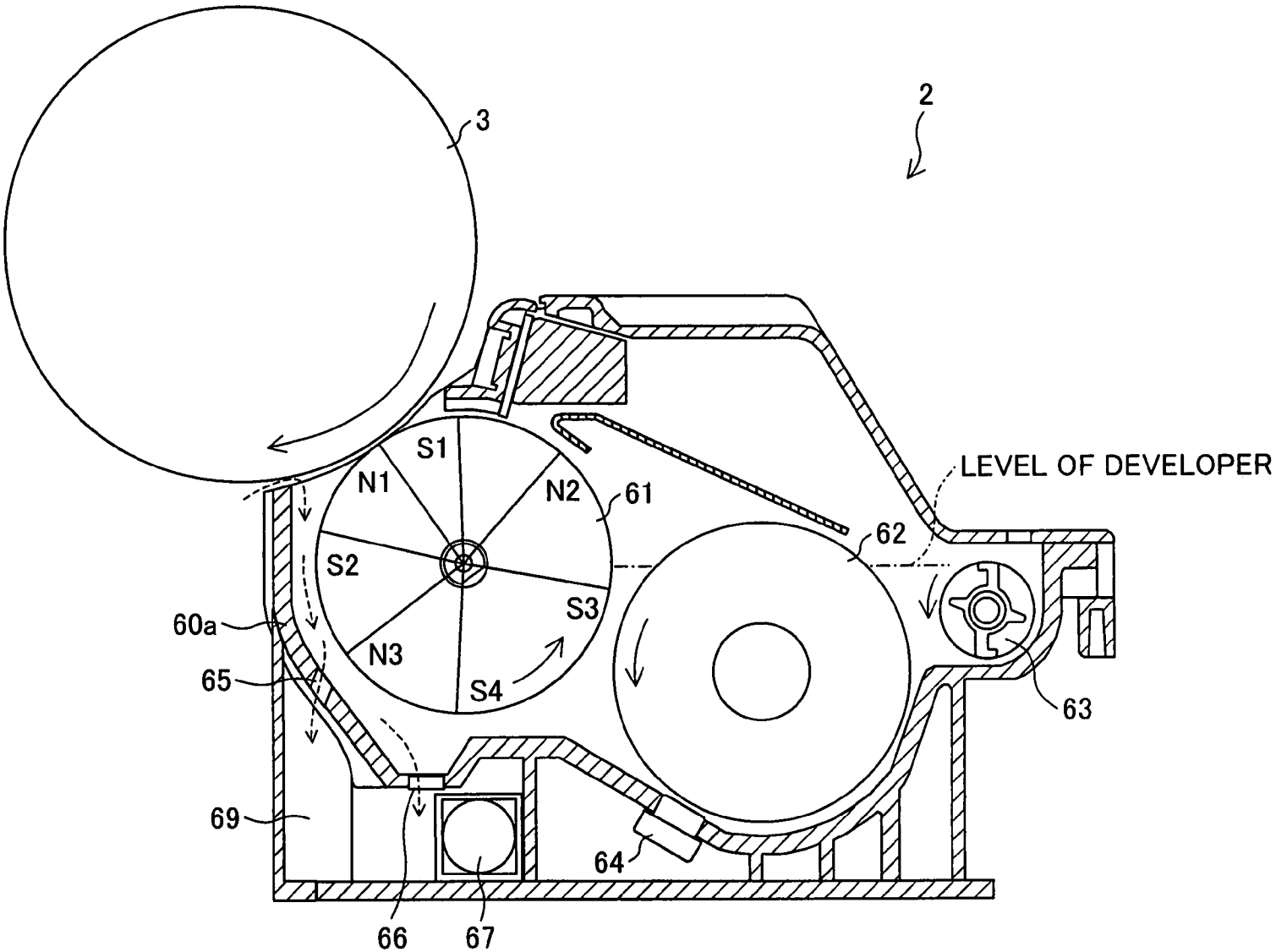
FIG. 8 is a cross sectional view illustrating a developing unit in the image forming apparatus of the embodiment, in accordance with the present invention.

Next, the following describes in detail the developing unit 2 of the image forming apparatus 100. FIG. 8 is a cross sectional view illustrating a schematic configuration of the developing unit 2.

As illustrated in the figure, the developing unit 2 includes: a developing roller 61; stirring rollers 62 and 63; a toner density sensor 64; a developer tank 60*a*; a fan 67; or the like.

The developer tank 60*a* serves as a storage tank for containing the toner and carrier, and includes therein the developing roller 61, and the stirring rollers 62 and 63. Further, in the developer tank 60*a*, the toner density sensor 64 is positioned to face the stirring roller 62. Further, the developer tank 60*a* has an aperture above the stirring roller 63. Through this aperture, the toner is supplied from a toner supplying container 7.

Further, the developer tank 60*a* is provided in the vicinity of the photosensitive drum 3, and has an aperture that faces the photosensitive drum 3. The photosensitive drum 3 is distanced by 2 mm or less from that edge of the aperture which is on a downstream side in the rotative direction of the photosensitive drum 3. This gap of 2 mm or less between the photosensitive drum 3 and the edge of the aperture restrains air that flows from the inside to the outside of the developer tank 60*a* as the result of the rotation of the photosensitive drum 3. Thereby, it is possible to restrain scattering of the toner.

The developing roller 61 is partially exposed from that aperture of the developer tank 60*a*, which faces the photosensitive drum 3. This developing roller 61 is a cylindrical roller, and is so provided that the exposed portion of the developing roller 61 faces the photosensitive drum 3. The developing roller 61 conveys the toner from the developer tank 60*a* (where the toner is contained) to that part of the developing roller 61 which is exposed and faces the photosensitive drum 3. Then, the electrostatic latent image on the photosensitive drum 3 is developed by adhering the toner to the electrostatic latent image, thus forming a toner image on the photosensitive drum 3. Note that the developing roller 61 rotates in the direction indicated by the arrow in FIG. 8.

The stirring rollers 62 and 63 have a function of stirring the toner in the developer tank 60*a*, so as to electrically charge the toner to a minute electric potential, and a function of conveying the toner to the developing roller 61.

The toner density sensor 64 is a sensor for detecting the toner density in the developer tank 60*a*. The result of the detection is transmitted to the control section 110. Based on the detection result, the control section 110 operates a supply roller (not shown) provided in the toner supplying container 7, so that a necessary amount of toner is supplied from the toner supplying container 7 to the developer tank 60*a*.

As indicated by the dotted arrow in FIG. 8, the fan 67 vents, out of the developing unit 2, the air inside the developer tank 60*a* so that the external air flows into the developer tank 60*a* from the gap between the photosensitive drum 3 and the developer tank 60*a*.

Figure 9:
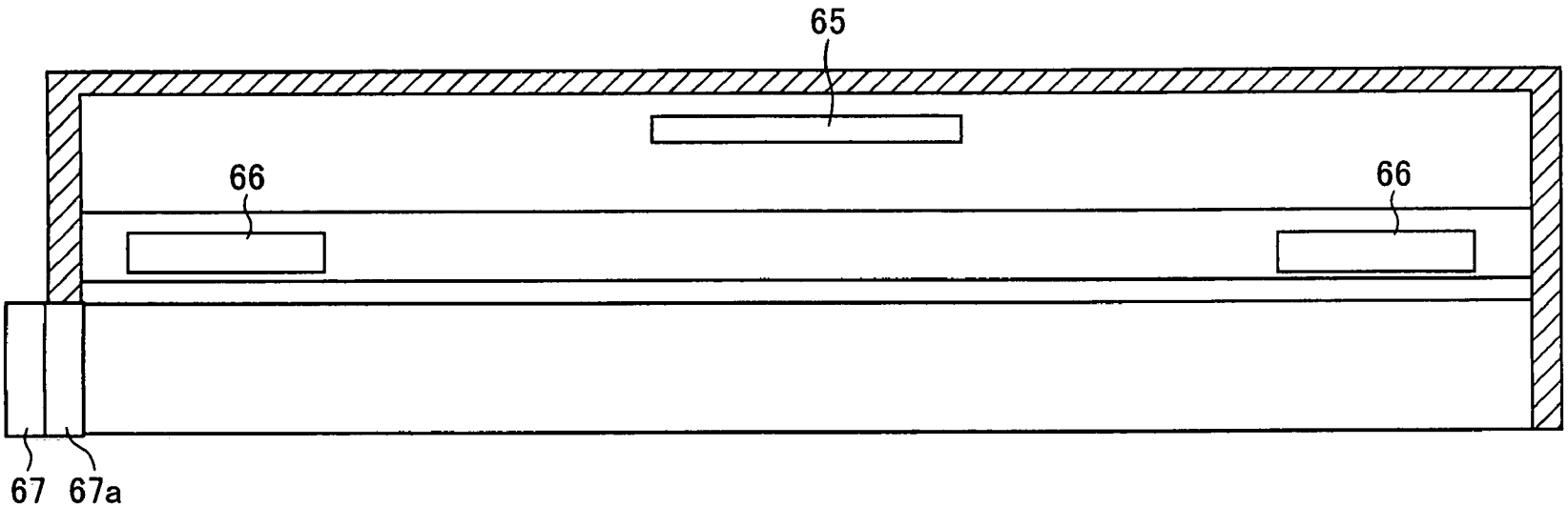
FIG. 9 is a plane view illustrating a part of the developing unit in the image forming apparatus of the embodiment in accordance with the present invention.

The developer tank 60*a* is provided with an air venting-out duct 69 under the developing roller 61. In an axial direction of the photosensitive drum 3 and the developing roller 61, this air venting-out duct 69 extends substantially in the entire length of the developer tank 60*a*. Further, a central suction hole 65 and end suction holes 66 are provided on a portion, of the developer tank 60*a*, which faces the air venting-out duct 69. FIG. 9 is a plane view illustrating the central suction hole 65 and the end suction holes 66 on the developer tank 60*a*. In FIG. 9, the central suction hole 65 and the end suction holes 66 are viewed from the developing roller 61. As illustrated in FIG. 9, the central suction hole 65 is provided nearby the center of the developer tank 60*a* in the lengthwise direction of the developing roller 61. Meanwhile, the end suction holes 66 are respectively provided nearby the respective ends of the developer tank 60*a* in the lengthwise direction of the developing roller 61. Further, as illustrated in FIG. 9, a toner filter (first developer removing device) 67*a* and a fan 67 are provided on one side of the air venting-out duct 69.

The air flown into the developer tank 60*a* through the gap between the photosensitive drum 3 and the developer tank 60*a* passes by the developing roller 61, and enters the air venting-out duct 69 through the central suction hole and the end suction holes 66. Then, the toner is removed (dust removal) by the toner filter 67*a*. After that, the air is vented out of the developing unit 2.

As described, the image forming apparatus 100 includes the isolating wall 1 which (i) surrounds the photosensitive drum 3; the charging device 5; the developing unit 2; the transfer device 6; the cleaning unit 4; the discharge lamp 12; and the fixing device 8, and (ii) isolates (shields) the these members from the exterior space. In other words, with the isolating wall 1, a space in which powder toner is dealt with is isolated from the exterior space of the insolating wall 1 (i.e., a space in which the toner (unfixed toner) which is not yet fixed on a sheet by the fixing device 8 is present is isolated from the exterior space of the isolating wall 1). Thus, the toner floating or dispersed in the image forming apparatus 100 is kept inside the image forming apparatus 100.

Further, the image forming apparatus 100 includes the heat dissipating fin (heat dissipating member 29*b*) provided on the part, of the isolating wall 1, which is beside the fixing device 8. With this heat dissipating fin 29*b*, the heat inside the isolating wall 1 is dissipated into the outside of the isolating wall 1. This facilitates dissipation of the heat out of the isolating wall 1, the heat having been dissipated inside the isolating wall 1 from the fixing device 8. Thus, it is possible to restrain an increase in the temperature inside the isolating wall 1.

Further, the image forming apparatus 100 includes the heat dissipating fin 29*a* which is provided on that part of the isolating wall 1 which is below the developing unit 2. With this heat dissipating fin 29*a*, the heat inside the isolating wall 1 is dissipated into the outside of the isolating wall 1. Further, the heat conductive member 28 is provided between the developing unit 2 and the isolating wall 1. This heat conductive member 28 is made of a material, such as aluminium, whose heat conductivity is large, so that the heat in the developing unit 2 is effectively transferred to the isolating wall 1. Thus, the heat inside the developing unit 2 is transferred to the isolating wall 1 via the heat conductive member 28. Then, by using the heat dissipating fin 29*a* provided outside the isolating wall 1, the heat having been transferred to the isolating wall 1 is effectively dissipated into the outside from the isolating wall 1.

The present invention is not limited to the present embodiment in which the thermal conductor 28 is provided only between the developing unit 2 and the isolating wall 1. The heat conductive member 28 may be also provided between the isolating wall 1 and another member inside the isolating wall 1. Further, in the present embodiment, the heat dissipating fins are respectively provided below the developing unit 2 and beside the fixing device 8. However, the present invention is not limited to this, and a heat dissipating fin may be further provided around the isolating wall 1. Further, the heat dissipating member on the isolating wall 1 is not limited to the heat dissipating fin, provided that the heat dissipating member increases the surface area of the isolating wall 1, and facilitates dissipation of the heat from inside to the outside of the isolating wall 1.

Further, the image forming apparatus 100 is provided with the heat insulating wall 83 around the fixing device 8. With the heat insulating wall 83, it is possible to prevent the dissipation of the heat from the fixing device 8 into the inside of the isolating wall 1. This restrains an increase in the temperature inside the isolation wall 1. Further, the heat insulating wall 83 protects a driving system (not shown) or the like for the fixing device 8 against the heat transferred from the fixing roller 81 or the pressure roller 82. Otherwise, the heat transferred from the fixing roller 81 or the pressure roller 82 to the driving system or the like for the fixing device 8 would cause a negative effect on the pressure roller 82 to the driving system or the like for the fixing device 8.

Figure 10:
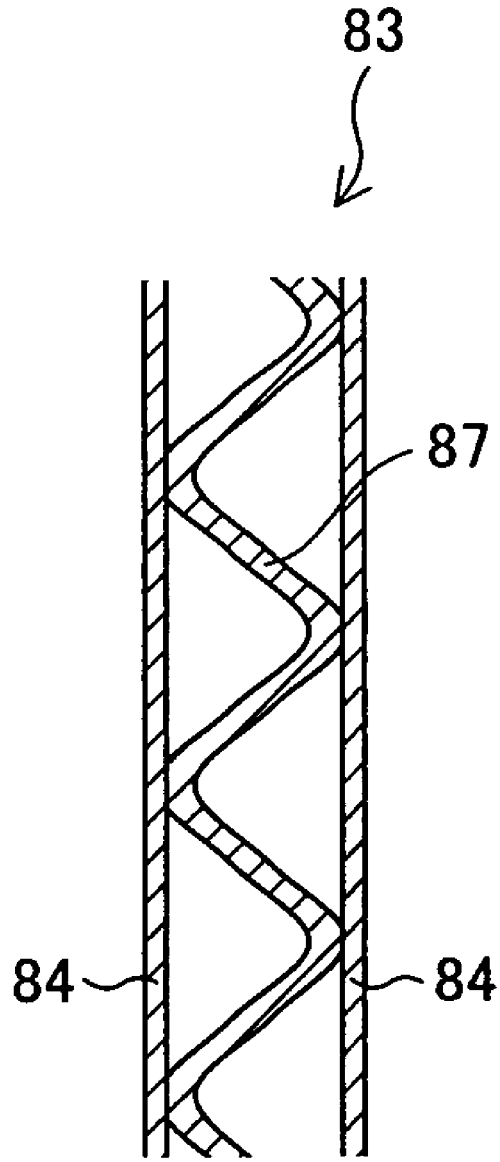
FIG. 10 is a cross sectional view illustrating another exemplary configuration of a heat insulating wall which is provided around the fixing device of the image forming apparatus of the embodiment, in accordance with the present invention.

The configuration of the heat insulating wall 83 is not limited to the one illustrated in FIG. 2. For example, as illustrated in FIG. 10, the heat insulating wall may be a wall including (a) a vacuum hollow part which is tightly sealed by external walls (external wrapping materials) 84, and (b) a wave-like shaped spacer material 87*s* being provided in the hollow part. In this case, the external walls 84 and the spacer material 87*s* may be made of metal such as stainless, and the spacer material 87*s* and the external walls 84 may be jointed with each other by spot welding at a position where the spacer material 87*s* and the external walls 84 abut each other. Alternatively, a glass bead or the like may be adopted as a spacer (not shown), instead of the spacer material 87*s*. In the above-described configurations, the heat insulating wall 83 is a vacuum heat insulating wall (vacuum insulation member) whose region sealed by the external walls is kept in the vacuum state. However, the heat insulating wall 83 is not limited to this, and the heat insulating wall 83 may be a reduced-pressure insulating member in which pressure inside an external wrapping material is reduced to a pressure which is lower than the atmospheric pressure. The heat insulating member is not limited to the above configuration, and various types and kinds of heat insulating members are adoptable.

Further, the fixing device 8 may be provided with a heat collecting device for: (a) collecting heat which is dissipated inside the isolating wall 1 through the heat insulating wall 83; and (b) supplying the collected heat energy to the fixing roller (heating member) 81 and/or the pressure roller (heating member) 82. For example, such a heat collecting device may be a heat pump 87 arranged nearby the fixing device 8 (see FIG. 11(*a*)).

Figure 11A:
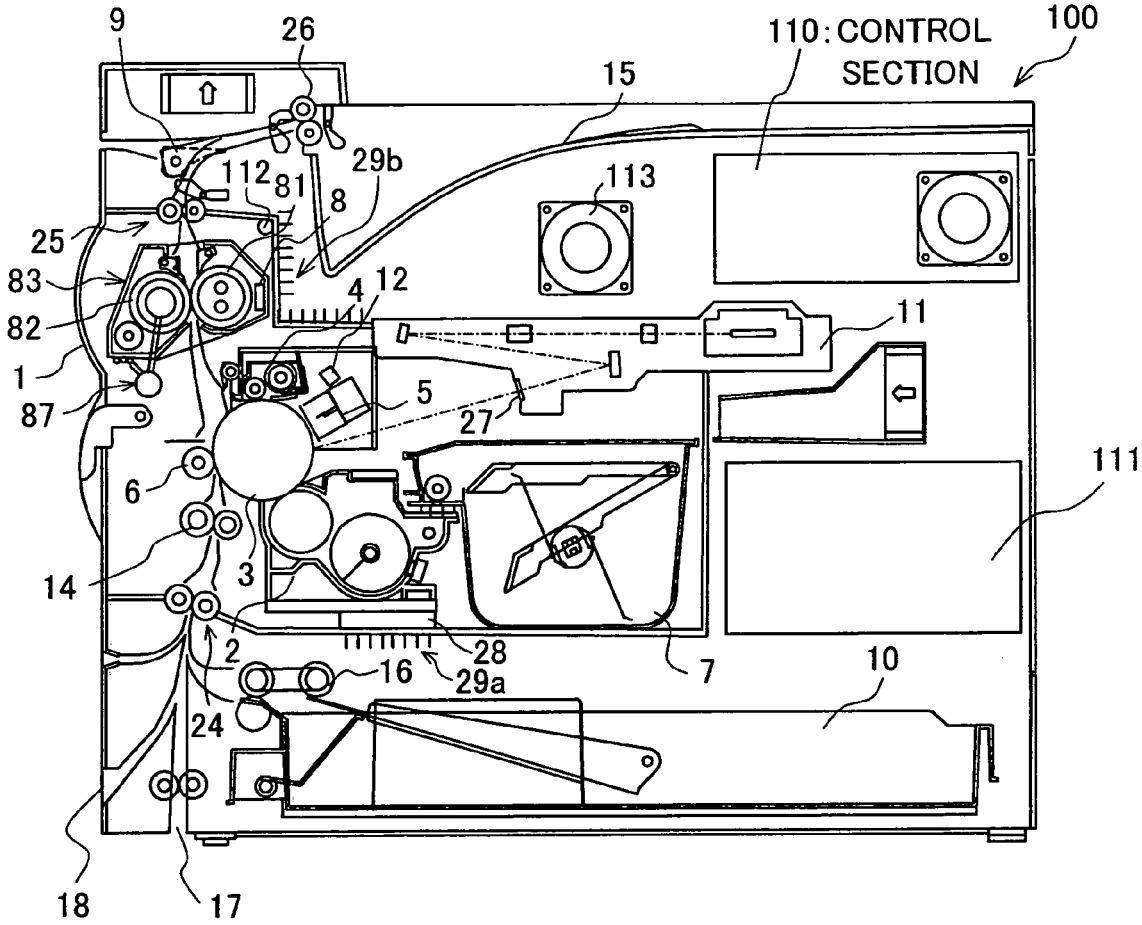
FIG. 11(*a*) is a cross sectional view illustrating an example where a heat pump is provided for the fixing device of the image forming apparatus of the embodiment, in accordance with the present invention.
Figure 11B:
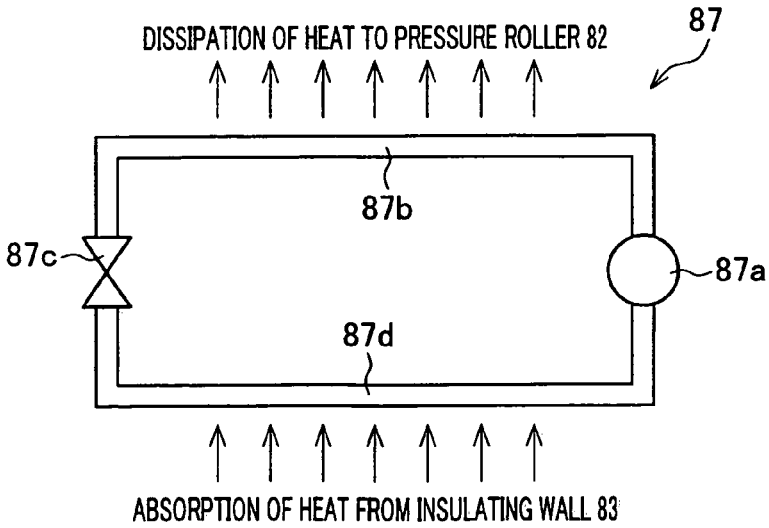

FIG. 11(*b*) is an explanatory diagram illustrating a schematic configuration of the heat pump 87. As illustrated in the figure, the heat pump 87 includes: a compressor 87*a;* a heat dissipating section 87*b;* an expansion valve 87*c;* and a heat absorbing section 87*d.* In this heat pump 87, a working fluid (not shown) is enclosed.

The compressor 87*a* compresses the working fluid in a saturated vapor state, thereby changing the state of the working fluid to a liquid state. Then, the working fluid in the liquid state is fed to the heat dissipating section 87*b.* The heat dissipating section 87*b* is provided nearby or inside the pressure roller 82, and heat exchange is carried out between the working fluid and the pressure roller 82, so that the heat of the working fluid is dissipated to the pressure roller 82. The working fluid, which is cooled down by dissipating the heat via the heat dissipating section 87*b,* becomes saturated liquid. Then, the saturated liquid is fed to the expansion valve 87*c.* Then, the working fluid is expanded in the expansion valve 87*c* thereby turning into wet vapor. The working fluid in a wet vapor state is fed to the heat absorbing section 87*d.* The heat absorbing section 87*d* is provided nearby the heat insulating wall 83, and causes the working fluid to absorb the heat transferred from inside the fixing device 8 through the heat insulating wall 83. Then, the working fluid having absorbed the heat from the heat insulating wall 83 via the heat absorbing section 87*d* is again turned into saturated vapor, and is fed to the compressor 87*a.* The above-described operation is repeated.

As described, the heat pump 87 collects the heat transferred from the fixing device 8 through the heat insulating wall 83, and supplies the collected heat to the pressure roller 82. This allows reduction of heating-use energy consumed in the fixing device 8. As a result, it is possible to reduce the power consumption.

Further, it is preferable that gears (a gear train; not shown) for driving the fixing roller 81 and the pressure roller 82 be made of a material whose heat conductivity is small. For example, The gears may be prepared by molding PPS (polyphenylene sulfide) in which hollow glass spheres (e.g. Scotch Light (product name) produced by Sumitomo 3M) of approximately 30 μm to 70 μm in particle diameter are mixed at a volume ratio of 20% to 30%. PPS is a heat resistant material. Glass fillers may be mixed in PPS as needed in order to improve the strength.

Further, the image forming apparatus 100 includes the charging device 5 which is a corona-discharge type charging device. It is known that a charging device which carries out a corona discharge process produces ozone as a corona product. If the ozone generated by the charging device reaches the photosensitive drum 3, a nitrogen oxide is generated on the surface of the photosensitive drum 3. This causes unevenness in electrically charging the photosensitive drum 3. This causes unstable image density of the toner image formed on the photosensitive drum 3.

In view of that problem, in the present embodiment, the charging device 5 of the image forming apparatus 100 is provided with the ozone filter 58. Further, with the use of the fan 59, the air is sucked into the charging device 5 from the aperture provided on the surface facing the photosensitive drum 3. The air having been sucked into the charging device 5 is lead to the ozone filter 58 via the vicinity of the sawtooth electrode 53. Then, the air passes through the ozone filter 58, and the ozone is absorbed and removed from the air. The air from which the ozone is removed is vented out of the charging device 5.

With this configuration, the ozone generated from a corona discharging at the charging device 5 (sawtooth electrode 53) is prevented from being vented towards the photosensitive drum 3, or from remaining inside the isolating wall 1. Thus, formation of the nitrogen oxide on the surface of the photosensitive drum 3 is prevented.

In the present embodiment, the ozone filter 58 is an activated-carbon type ozone filter. However, the ozone filter 58 is not limited to this, as long as the ozone filter 58 is capable of removing ozone. For example, it is possible to adopt a catalytic type ozone filter such as CAO Filter (product name) produced by Toyobo Ltd. Further, instead the ozone filter 58, it is possible to adopt means for decomposing ozone into a substance that causes no contamination.

Figure 12:
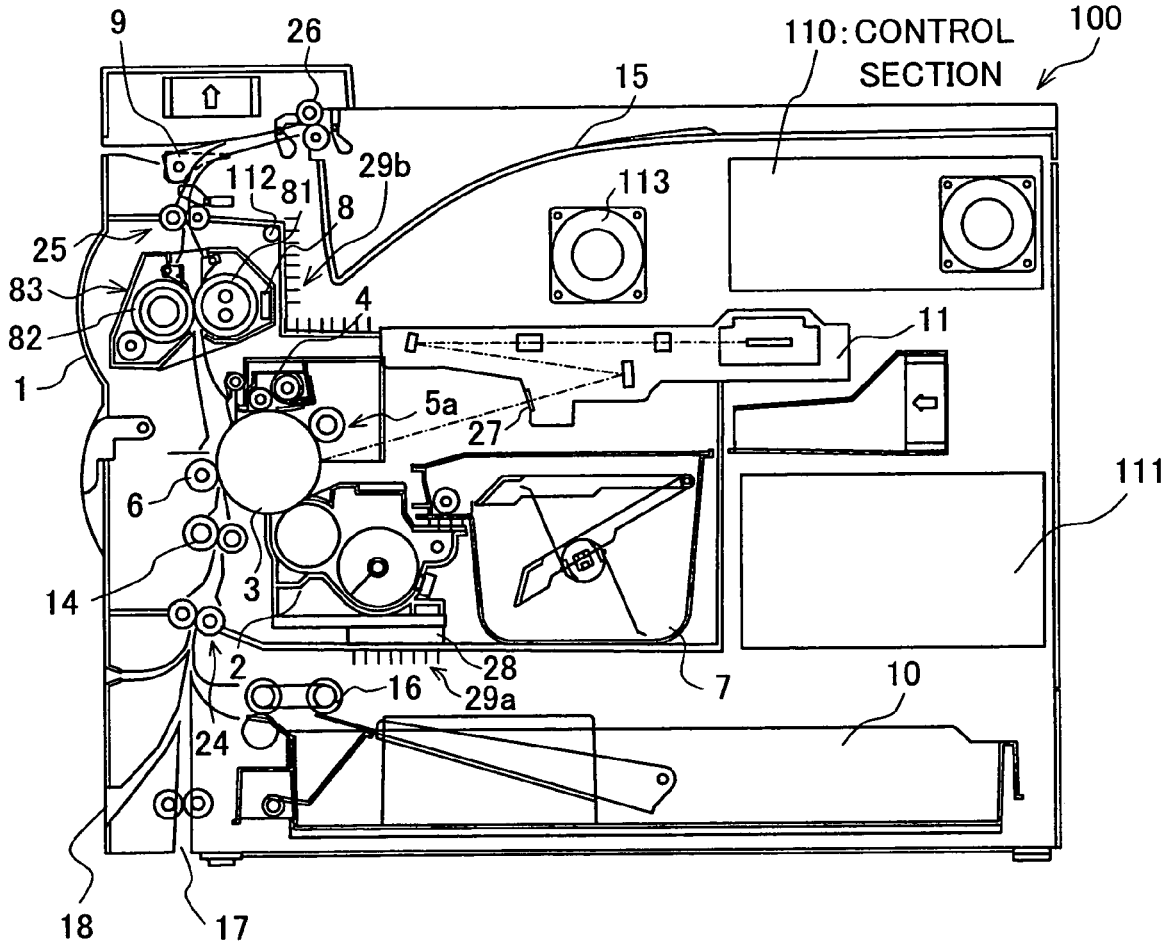
FIG. 12 is a cross sectional view illustrating an example where a charge roller is used as a charging device in the image forming apparatus of the embodiment, in accordance with the present invention.

Further, in the present embodiment, a charging device 5 is a corona-discharge type charging device. However, the charging device 5 is not limited to this, and the charging device 5 may be a contact-charge type charging device. For example, as illustrated in FIG. 12, it is possible to adopt a charge roller (charging device) 5*a* which is a contact-charge type charging device, instead of adopting the corona-discharge type charging device 5. Apart from the charge roller, the contact-charge type charging device may be, for example, a charging device using a brush.

In a case of using the contact-charge type charging device, a voltage and current applied to the charging device can be lower, compared to the case of adopting the corona-discharge type charging device. Accordingly, it is possible to (i) downsize the power supply device, (ii) reduce the power consumption, and (iii) restrain the amount of ozone production.

Further, even in the case of adopting the contact-charge type charging device, it is preferable that the fan 59 be used for leading the air around the charge roller 5*a* to the ozone filter 58, so that the ozone produced by the charging device is absorbed and removed from the air. This more effectively prevents the ozone from remaining inside the isolating wall 1, or from reaching the surface of the photosensitive drum 3.

Further, the image forming apparatus 100 is arranged such that the optical scanning unit 11 is provided outside the isolating wall 1 and the transparent cover member 27 is provided to allow the light beam from the optical scanning unit to reach inside the isolating wall. This prevents the floating toner inside the isolating wall 1 from being adhering onto various optical members of the optical scanning unit 11. As such, it is possible to prevent deterioration in image forming accuracy, the deterioration being caused by the floating toner adhered to the optical system of the optical scanning unit 11.

Further, the developing unit 2 in the image forming apparatus 100 includes a fan (a second suction device) 67 for sucking, into the inside of the developer tank 60*a,* the air between the developer tank 60*a* and the photosensitive drum 3. This restrains the toner inside the developer tank 60*a* from dispersing into the outside of the developer tank 60*a.*

Further, the developing unit 2 is provided with a toner filter (developer removing device) 67*a* for removing the toner. With the provision of the toner filter 67*a,* the air having been sucked in from the gap between the developer tank 60*a* and the photosensitive drum 3 can be vented out of the developing unit 2 after removing the toner from the air. Accordingly, it is possible to reduce the amount of the toner floating or dispersed in the isolating wall 1.

Further, in the image forming apparatus 100, that side of the isolating wall 1 which is above the fixing device 8 is tilted with respect to the plane perpendicular to the vertical direction. Further, below a lower end portion of the tilted surface of the isolating wall 1, the drain hole (outlet hole) 112 is provided for letting (discharging) the moisture out of the isolation wall 1.

When the sheet is heated by the fixing device 8, the moisture contained in the sheet may be evaporated. This vapor may form dew on that surface of the isolating wall 1 which faces the fixing device 8 from above. However, the tilt of this surface leads the dew formed on this surface to the drain hole 112. Then, through the drain hole 112, the dew is let out (discharged) to the outside of the isolating wall 1.

Further, the drain hole 112 is provided with the filter (second developer removing device) which prevents the toner from going out of the isolating wall 1, while allowing the moisture to pass. Thus, the toner floating or dispersed inside the isolating wall 1, is prevented from going outside.

Further, on the outer surface of the isolating wall 1, the heat dissipating fin 29*b* is provided nearby the drain hole 112. Further, the image forming apparatus 100 includes the fan 113 for venting, to the outside the image forming apparatus 100, the air which is out of the isolating wall 1 but in the image forming apparatus 100. Thus, the moisture let out through the drain hole 112 is evaporated by the heat dissipating fin 29*b*, and sent out of the image forming apparatus 100 by the fan 113.

Further, the sealing materials 101 and 102 are provided between the isolating wall 1 and the transporting rollers 24 and 25. These sealing materials prevent the toner floating inside the isolating wall 1 from going outside the isolating wall 1. With these sealing materials 101 and 102, the toner floating or dispersed inside the isolating wall 1 is prevented from flying from the periphery of the transporting rollers 24 and 25 to the outside of the isolating wall 1.

In the present embodiment, the sealing material 101 is made of felt, and the sealing material 102 is made of polyethylene terephthalate film. However, the material for the sealing materials 101 and 102 are not limited to these. However, it is preferable that the sealing materials 101 and 102 be made of a material which less likely causes abrasion on the surfaces of the transporting rollers 24*a* and 24*b*, or a material which less likely wears off or causes a damage to the transporting roller 24*a* and 24*b* despite the material rubs the transporting roller 24*a* and 24*b*. Further, it is preferable that a friction resistance between (a) the sealing materials 101 and 102 and (b) the transporting rollers 24*a* and 24*b* be small.

Further, in the image forming apparatus 100, the pressure inside the isolating wall 1 and the pressure outside the isolating wall 1 are kept even by the drain hole 112. In other words, the drain hole 112 functions as a pressure equalizing section which equalizes the pressure inside the isolating wall 1 and the pressure outside the isolating wall 1. This more appropriately prevents the toner floating inside the isolating wall 1 from going outside of the isolating wall 1. Further, it is possible to prevent a difference in the pressure inside the isolating wall 1 and the pressure outside the isolating wall 1. The pressure difference between inside and outside the isolating wall 1 would cause a sudden dispersion of the floating toner from the inside of isolating wall 1, e.g., when the isolating wall 1 is opened at the time of maintenance or the like.

Note that the present embodiment deals with the case where the pressure equalizing section for maintaining the pressures inside and outside the isolating wall 1 is the drain hole 112. However, the pressure equalizing section is not limited to this. For example, the above-mentioned sealing materials 101 and 102 may be used as the pressure equalizing section. More specifically, the pressures inside and outside the isolating wall 1 may be kept even by adopting sealing materials 101 and 102 made of a material that has air permeability but is capable of surely preventing the floating toner from going out of the isolating wall 1. Alternatively, other means may be provided which equalizes the pressures inside and the outside the isolating wall 1 without letting the toner floating out of the isolating wall 1.

Figure 13:
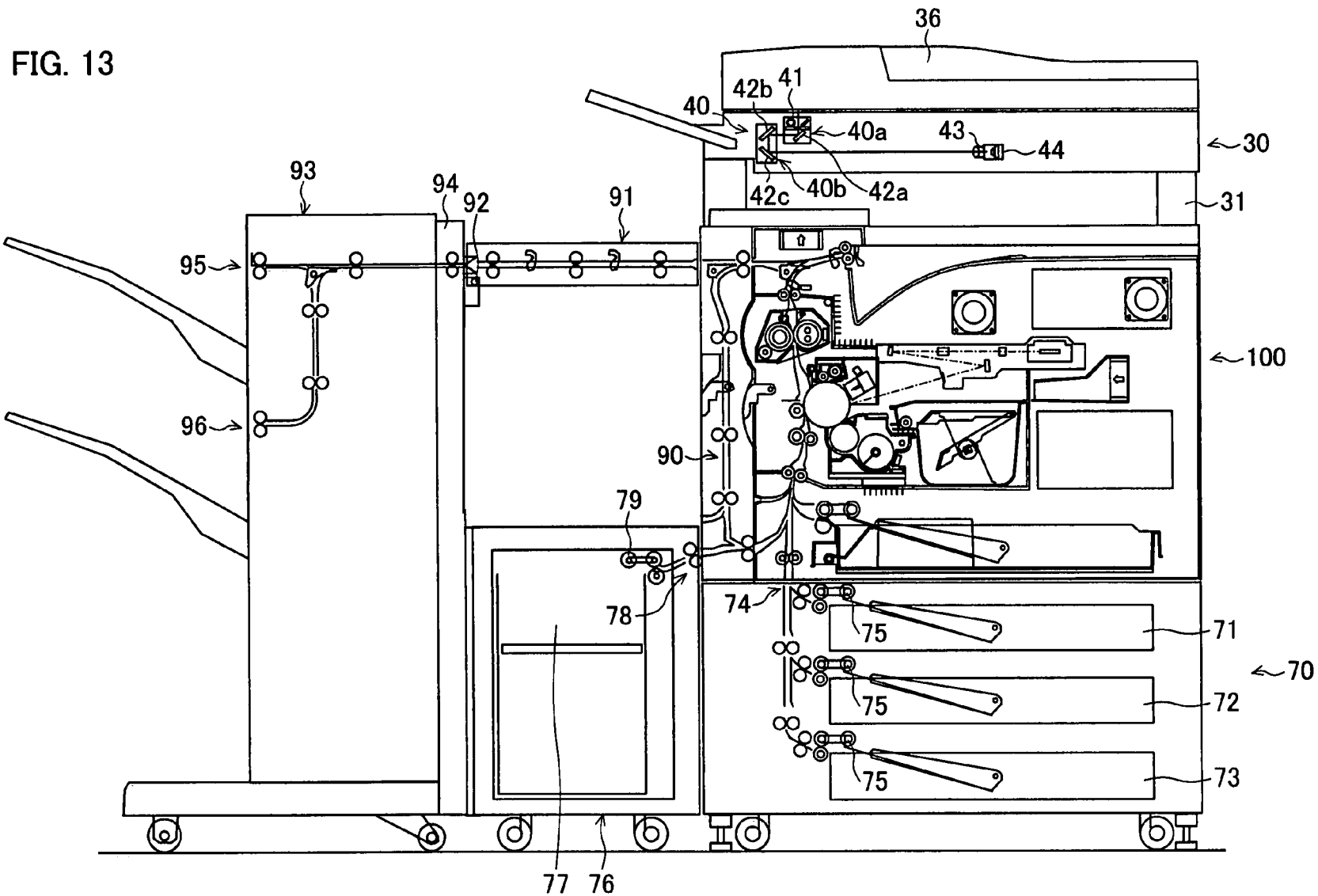
FIG. 13 is a cross sectional view illustrating an exemplary configuration in which various expansion features are connected to the image forming apparatus of the embodiment in accordance with the present invention.

Further, various peripheral devices may be mounted to the image forming apparatus 100, as a device for extended operation. For example, as illustrated in FIG. 13, it is possible to detachably mount, to the image forming apparatus 100: an image reading device (image reading device, reading-use optical system) 30; a recording material supplying device 70; a recording material supplying device 76; a recording material re-supplying/feeding device 90; a feed-relaying device 91; a post-process device; or the like. Further, the control section 110 is capable of integrally controlling all of the sections in the image forming apparatus 100 and the expansion device being mounted to the image forming apparatus 100. With the control section 110, each section of the image forming apparatus 100 and the expansion device are operated in association with each other.

As illustrated in FIG. 13, the image reading apparatus 30 includes: a document table 35 which is made of a transparent glass; an automatic document feeding device 36 for automatically feeding and supplying a document on the document table 35; and a document image reading unit (i.e. scanner unit) 40 for reading an image on the document by scanning the image, the document being placed on the document table 35. With this configuration, the image reading apparatus 30 exposes and scans an image on the document being set on the transparent document table 35, and form an image on a photoelectric transducer, thereby converting the image on the document into an electric signal. Then, the image reading apparatus 30 transmits, as image data, the electric signal to the image forming apparatus 100. The image data having been transmitted to the image forming apparatus 100 then undergoes a predetermined image processing.

When a plurality of documents are set all at once on a predetermined document tray (not shown), the automatic document feeding device 36 serves as a device for feeding the documents one-by-one to the document table 35. Then, after the document image on each of the documents is read by the scanner unit 40, the automatic document feeding device 36 feeds the documents to a predetermined position for taking out the document.

The scanner unit 40 is a document image reading unit which reads, in a line-by-line manner, the image on the document having been fed to the document table 35. As illustrated in FIG. 13, such a scanner unit 40 includes: a first scanning unit 40*a*; a second scanning unit 40*b*; an optical lens 43; and a CCD 44.

The first scanning unit 40*a* exposes the document, while moving from the left to the right of the document table 35, at a constant speed V. Further, as illustrated in FIG. 13, the first scanning unit 40*a* includes: a lamp reflector assembly 41 for irradiating light; and a first reflecting mirror 42*a* for guiding, to the second scanning unit 40*b*, light reflected from the document.

The second scanning unit 40*b* moves at a speed of V/2, and follows the first scanning unit 40*a*. Further, the second scanning unit 40*b* includes second and third reflecting mirrors 42*b* and 42*c* for guiding light reflected from the first reflecting mirror 42*a* to the optical lens 43 and the CCD 44.

The optical lens 43 is for forming light image on a CCD 44 by focusing thereon the light reflected from the third reflecting mirror 42*c*.

By the CCD (photoelectric conversion element) 44, the light focused by the optical lens 43 is converted into an electrical signal (electrical image signal). The analogue electric signal obtained by using the CCD 44 is converted into image data of a digital signal, on a CCD board (not shown) having the CCD 44. This image data is subjected to various image processings in an image processing section, and then is stored in a memory (not shown). Then, the image data is transmitted to the image forming apparatus 100, in accordance with an instruction from the control section 110.

Further, the automatic document feeding device includes a contact image sensor (CIS; not shown). This CIS integrally includes: a light source for carrying out an exposure with respect to the top surface of the document; an optical lens for guiding a light image to an photoelectric conversion element; and the photoelectric conversion element for converting the light image into image data. Thus, in the process in which the automatic document feeding device feeds the document along the document feeding path, the image reading apparatus 30 is able to simultaneously read the document image on front and back surfaces of the document.

As described, through a correlated operations of the automatic document feeding device 36 and the scanner unit 40 in the image reading apparatus 30, the documents to be read are placed on the document table 35 one after another, and the scanner unit 40 moves along the bottom surface of the document stage 35 for reading the document image on each of the document.

Further, the image reading apparatus 30 has an automatic reading mode and a manual reading mode. The automatic reading mode is a mode in which the automatic document feeding device feeds sheet documents one by one, and the document image of each of the document is read by successively exposing and scanning the document. The manual reading mode is used, for example, in a case of reading an image of: a document such as a book; or a sheet document which the automatic document feeding device is not able to feed. In this case, a document is manually placed on the document table 35.

In the image forming apparatus 100, the isolating wall 1 prevents the toner floating in the apparatus from being scattered over the image reading apparatus 30, thus preventing adhesion of the floating toner onto optical members (lens, mirror, etc.) of the image reading apparatus 30. This prevents deterioration of the image reading accuracy caused by the toner adhered to the optical members of the image reading apparatus 30.

The recording material supplying device 70 serves as a recording material holding tray for holding a sheet to be used as a recording material in the image forming apparatus 100. As illustrated in FIG. 13, the recording material supplying device 70 includes recording material supplying sections 71 to 73, and a recording material outputting section 74. For example, the recording material supplying sections 71 to 73 respectively holds thereon sheets of various sizes or materials. Further, the recording material supplying device 70 also serves as a desk for placing thereon the image forming apparatus 100, and is attachable to or detachable from the image forming apparatus 100.

The recording material supplying sections 71 and 73 stores therein the sheets (recording materials) to be supplied to the image forming apparatus 100. One of the recording material supplying sections 71 to 73 is selected in accordance with the control section 110 in the image forming apparatus 100. Then, the recording material supplying device 70 causes the pick-up roller 75 of the selected recording material supplying section to individually supply, to the recording material outputting section 74, sheets stored in the selected recording material supplying section. Further, the sheet outputted from the recording material outputting section 74 is sent to a sheet accepting aperture 17 provided at the bottom of the image forming apparatus 100.

As illustrated in FIG. 1, at the bottom surface of the image forming apparatus 100, there is provided the sheet accepting aperture 17 for (i) successively accepting the sheets fed from the recording material supplying device 70, and (ii) successively feeding the sheets to the transfer section between the photosensitive drum 3 and the transfer device 6. Thus, the image forming apparatus 100 is able to carry out the image forming process with respect to the sheets being fed from the recording material supplying device 70, as is done with respect to the sheets from the supply tray 10.

For replenishment of sheets thereto, or replacement of the sheets stored therein, the recording material supplying section (71 to 73) is pulled out from the front side of the main casing of the recording material supplying device 70.

Note that the recording material supplying device 70 includes three recording material supplying sections 71 to 73. However, the recording material supplying device 70 may include: at least one recording material supplying section and at least one recording material outputting section.

As illustrated in FIG. 13, the recording material supplying device 76 includes a recording material supplying section 77 and a recording material outputting section 78. The recording material supplying section 77 serves as a recording material storing tray for storing therein a sheet. Note that the recording material supplying device 76 is capable of storing therein larger quantity of sheets, compared to the supply tray 10 in the image forming apparatus 100, or the recording material supplying sections 71 to 73 of the recording material supplying device 70.

By using the pick-up roller 79 or the like operating in accordance with the control section 110 provided in the image forming apparatus 100, the recording material supplying device 76 supplies, one by one, the sheets stored in the recording material supplying section 77 to the recording material outputting sections 78 on the right side surface of the recording material supplying device 76. Further, the sheet outputted from the recording material outputting section 78 is sent to a record material accepting aperture 18 provided at a lower portion of the image forming apparatus 100.

As illustrated in FIG. 1, on a lower side surface of the image forming apparatus 100, there is provided the recording material accepting aperture 18 for successively accepting the sheets sent from the recording material supplying device 76, and successively sending the sheets to the transfer section between the photosensitive drum 3 and the transfer device 6. Thus, the image forming apparatus 100 is able to carry out the image forming process with respect to the sheets being fed from the recording material supplying device 76, as is done with respect to the sheets from the supply tray 10.

The recording material re-supplying/feeding device (recording material feeding path unit) 90 is used when forming an image on both sides of the sheet. This recording material re-supplying/feeding device 90 (i) turns over the sheet upside down after an image is recorded on one of its surfaces, and (ii) re-sends the sheet to the transfer section between the photosensitive drum 3 and the transfer device 6 in the image forming apparatus 100.

When duplex image formation is performed for both sides of the sheet by using the image forming apparatus 100, the inverting roller 26 turns over the sheet on which a toner image has been fixed on one of its surfaces. Then, the sheet having been turned over is fed to the output-sheet receiving tray 15.

In this case, however, the sheet is not completely outputted, and the inverting roller 26 interposing the sheet is reversed. Then, the sheet is reverse-fed in an opposite direction; i.e., towards the recording material re-supplying/feeding device 90.

At this point, the switching gate 9 illustrated in FIG. 1 is switched from a status indicated by the solid line to a status indicated by the dotted line. Thus, the sheet having been reverse-fed is re-supplied to the transfer section of the image forming apparatus, through the recording material supplying and feeding device 90.

As illustrated in FIG. 13, the feed-relaying device 91 is arranged between the recording material re-supplying/feeding device 90 and the post-process device 93. This feed-relaying device 91 transfers, to the post-process device 93, the sheet from the image forming apparatus 100, the sheet having been subjected to the image forming process. Note that, the feed-relaying device 91 is supported so that the entire feed-relaying device 91 turns on its turning-support point 92 at which the feed-relaying device 91 is connected with the post-process device 93.

The post-process device 93 is for carrying out a post-process, such as punching or stapling, with respect to an image-formed sheet fed from the image forming apparatus 100.

As illustrated in FIG. 13, the post-process device 93 includes: a receiving/feeding section 94; a first recording material outputting section 95; and a second recording material outputting section 96. The receiving/feeding section 94 receives the sheet having been fed from the image forming apparatus 100, via the feed-relaying device 91. Further, in accordance with an instruction from the control section 110, the post-process device 93 feeds the image-formed sheet fed from the image forming apparatus 100, to one of the first and second recording material outputting sections 95 and 96.

The first recording material outputting section 95 is an outputting section which outputs the sheet received from the receiving/feeding section 94, as it is.

The second recording material outputting section 96 is an outputting section for outputting a sheet which has been subjected to the post-process by using a post-process device (not shown). The post-process device is a device for carrying out the post-process, such as stapling or punching, with respect to a sheet having been received by the receiving/feeding section 94, and for outputting the post-processed sheet.

For example, the post-process device may be: (i) a post-process device which staples a predetermined number of sheets; (ii) a post-process device which folds a sheet; (iii) a post-process device which perforate a hole for use in filing; (iv) a post-process device which has a several bins to several tens of bins, for sorting the sheets. Any one of the above-described post-process devices is selected, and is mounted to the post-process device 93.

In order to solve aforementioned problems, an image forming apparatus of the present invention includes: a photoreceptor for forming an electrostatic latent image thereon; a developing device for visualizing, by using powder developer, the electrostatic latent image formed on the photoreceptor; a transfer device for transferring, onto a recording material, an image visualized by the developing device; a fixing device for fixing the powder developer on the recording material by heating and melting the powder developer; and an isolating member for isolating a first space from a second space, the first space being a space in which the powder developer which is not yet fixed on the recording material is present, and the second space being a space outside the isolating member.

With this configuration, it is possible to isolate, from the outside space (second space), the space (first space) in which the powder developer which is not fixed on the recording material is present. This will not let the floating powder developer out of the isolating member, even if the unfixed powder developer floats inside the image forming apparatus. As such, it is possible to keep the floating powder developer inside the image forming apparatus, and to prevent the floating powder developer from adhering on a member provided outside the isolating member. As a result, it is possible to avoid making dirty an environment surrounding the image forming apparatus with the floating toner and/or deteriorating function of the image forming apparatus.

Further, the image forming apparatus of the present invention may include a heat dissipating member, provided on an outer surface of the isolating member, for facilitating dissipation of heat from the first space into the second space.

With this configuration, the heat in the space isolated by the isolating member is dissipated into the outside the isolating member, while preventing the powder developer from going outside the isolation wall. Thus, it is possible to restrain an increase in the temperature of the space isolated by the isolating member.

Further, the image forming apparatus of the present invention may include a heat conductive member for facilitating conduction of heat from the developing device to the isolating member. The heat conductive member may be made of a material having a higher heat conductivity than that of the space isolated by the isolating member.

The heat conductive member induces conduction of the heat inside the developing device to the isolating member. Thus, it is possible to restrain an increase in the temperature of the developing device.

Further, the image forming apparatus of the present invention may further include an heat insulating member for restraining dissipation of heat from the fixing device into the first space. For example, the heat insulating member may be: the heat insulating member is (i) a vacuum heat insulating member having therein a vacuum region inside an exterior wrapping material, or (ii) a reduced-pressure heat insulating member having a region whose pressure is reduced to be less than an atmospheric pressure, the region being inside an exterior wrapping material.

With this configuration, it is possible to restrain the heat inside the fixing device from being diffused into the space isolated by the isolating member. Thus, it is possible to restrain an increase in the temperature of the space isolated by the isolating member. Further, a fixing device driving system is protected against the heat from the fixing device to the driving system, the heat being generated in the fixing process. Otherwise, the heat would cause a negative effect on the driving system.

Further, the image forming apparatus of the present invention may include a heat collecting device for (i) collecting heat of the fixing device, which heat being dissipated in the first space, and (ii) supplying the collected heat to a heating member of the fixing device.

With this configuration, it is possible to reduce an amount of energy used for heating the fixing device. This allows reduction of the power consumption.

Further, the image forming apparatus of the present invention may include a charging device for electrically charging the photoreceptor, wherein the charging device includes: a first suction device for (i) sucking, into the charging device, air between the charging device and the photoreceptor and (ii) causing the air to pass through the inside of the charging device; and an ozone removing device for removing or decomposing ozone contained in the air having passed through the inside of the charging device by the first suction device, the air being let out of the charging device after the ozone in the air has been removed or decomposed by the ozone removing device.

With this configuration, it is possible to prevent the ozone produced by the charging device from (i) being vented towards the photoreceptor, or (ii) remaining in the space isolated by the isolating member. Thus, it is possible to prevent the ozone from reaching the surface of photoreceptor. This prevents the formation of nitrogen oxide on the surface of the photoreceptor. As a result, it is possible to prevent (i) unevenly electrifying the surface of the photoreceptor, and (ii) prevent unstable image density of an image developed on the photoreceptor.

Further, the image forming apparatus of the present invention may include an exposure device provided in the second space, for exposing a surface of the photoreceptor so as to form the electrostatic latent image.

With this configuration, it is possible to prevent the floating powder developer from adhering onto an optical member in the exposure device. Thus, an image forming accuracy will not be deteriorated by the floating powder developer adhered to the optical member in the exposure device.

Further, the image forming apparatus of the present invention may include an image reading device provided in the second space, for reading an image on a document.

With this configuration, it is possible to prevent the powder developer floating inside the isolating member from dispersed over the image reading device. Thus, it is possible to prevent an image reading accuracy from being deteriorated due to the adhesion of the powder developer on an optical member in the image reading device.

Further, the image forming apparatus of the present invention may be arranged so that the developing device includes: a second suction device for sucking, into the developing device, air between the developing device and the photoreceptor; and a first developer removing device for removing the powder developer contained in the air having been sucked into the developing device, the air being let out of the developing device after the powder developer has been removed from the air by the first developer removing device.

In this configuration, the second suction device sucks, into the developing device, the air between the developing device and the photoreceptor. This prevents the powder developer floating inside the developing device from being dispersed into the space isolated by the isolating member. Further, the second developer removing device removes the powder developer from the air having been sucked in by the second suction device. After the powder developer has been removed therefrom, the air is let out of the developing device. Thus, it is possible to reduce an amount of the powder developer floating or dispersed in the space isolated by the isolating member.

Further, the image forming apparatus of the present invention may be arranged such that the isolating member has (i) a outlet hole for letting dew-forming moisture out of the first space into the second space, and (ii) above the fixing device, a region being tilted with respect to a plane perpendicular to a vertical direction so that the dew formed on the region will be lead to the outlet hole.

For example, the moisture contained in the recording material is evaporated by an application of heat in the fixing device. This vapor may form dew on a region of the isolating member above the fixing device. However, with this amendment, the dew is led to the outlet hole along the tilt of the region, and is let out of the isolating member via the outlet hole. Accordingly, it is possible to prevent accumulation of dew-forming moisture in the space isolated by the isolating member.

Further, the image forming apparatus of the present invention may include: a second developer removing device provided to the outlet hole, the second developer removing device allowing moisture from the isolating member to pass therethrough, but removing the powder developer.

With this configuration, the powder developer floating in the space isolated by the isolating member is prevented from going outside the isolating member, whereas the moisture in the space isolated by the isolating member is let out of the isolating member.

Further, the image forming apparatus of the present invention may be arranged such that the isolating member includes (i) a transporting member for transporting the recording material into the first space, and (ii) an output member for outputting the recording material to the second space; and a sealing material is provided (i) in a gap between the isolating member and the transporting member and (ii) in a gap between the isolating member and the outputting member, so as to prevent the powder developer floating in the first space from going to the second space.

With this configuration, the powder developer floating in the space isolated by the isolating member is prevented from going outside the isolating member from the periphery of the transporting member and the outputting member.

Further, the image forming apparatus of the present invention may include a pressure equalizing section for equalizing a pressure between the first space and the second space.

With this configuration, the powder developer floating in the space isolated by the isolating member is suitably prevented from going out of the isolating member. Further, this configuration prevents a difference in pressure between the inside and outside the isolating member. This prevents rapid dispersion of the floating powder developer from the space isolated by the isolating member, for example, when the isolating member is opened for maintenance or the like.

The image forming apparatus of the present invention is generally applicable to an image forming apparatus in which an electrostatic latent image formed on a photoreceptor is visualized by using powder developer by an electrophotographic recording method or an electrostatic recording method.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. An image forming apparatus comprising:

a photoreceptor for forming an electrostatic latent image thereon;

a developing device for visualizing, by using powder developer, the electrostatic latent image formed on the photoreceptor;

a transfer device for transferring, onto a recording material, an image visualized by the developing device;

a fixing device for fixing the powder developer on the recording material by heating and melting the powder developer;

an isolating member for isolating a first space from a second space, the first space being a space inside the isolating member in which the photoreceptor, the developing device, the transfer device and the fixing device are provided and in which the powder developer which is not yet fixed on the recording material is present, and the second space being a space outside the isolating member in which an exposure device and a recording material holding member are provided; and a pressure equalizing section for equalizing a pressure between the first space and the second space wherein:

the isolating member includes (i) a transporting member for transporting the recording material into the first space, and (ii) an output member for outputting the recording material to the second space; and a sealing material is provided (i) in a gap between the isolating member and the transporting member and (ii) in a gap between the isolating member and the outputting member, so as to prevent the powder developer floating in the first space from going to the second space.

2. The image forming apparatus as set forth in claim 1, comprising:

a heat dissipating member, provided on an outer surface of the isolating member, for facilitating dissipation of heat from the first space into the second space.

3. The image forming apparatus as set forth in claim 2, comprising:

a heat conductive member for facilitating conduction of heat from the developing device to the isolating member.

4. The image forming apparatus as set forth in claim 1, further comprising:

an heat insulating member for restraining dissipation of heat from the fixing device into the first space.

5. The image forming apparatus as set forth in claim 4, wherein the heat insulating member is (i) a vacuum heat insulating member having therein a vacuum region inside an exterior wrapping material, or (ii) a reduced-pressure heat insulating member having a region whose pressure is reduced to be less than an atmospheric pressure, the region being inside an exterior wrapping material.

6. The image forming apparatus as set forth in claim 1, further comprising:

a heat collecting device for (i) collecting heat of the fixing device, which heat being dissipated in the first space, and (ii) supplying the collected heat to a heating member of the fixing device.

7. The image forming apparatus as set forth in claim 1, comprising:

a charging device for electrically charging the photoreceptor, wherein the charging device includes:

a first suction device for (i) sucking, into the charging device, air between the charging device and the photoreceptor and (ii) causing the air to pass through the inside of the charging device; and an ozone removing device for removing or decomposing ozone contained in the air having passed through the inside of the charging device by the first suction device, the air being let out of the charging device after the ozone in the air has been removed or decomposed by the ozone removing device.

8. The image forming apparatus as set forth in claim 1, comprising:

an exposure device provided in the second space, for exposing a surface of the photoreceptor so as to form the electrostatic latent image.

9. The image forming apparatus as set forth in claim 1, comprising:

an image reading device provided in the second space of the isolating member, for reading an image on a document.

10. The image forming apparatus as set forth in claim 1, wherein:

the developing device includes:

a second suction device for sucking, into the developing device, air between the developing device and the photoreceptor; and a first developer removing device for removing the powder developer contained in the air having been sucked into the developing device, the air being let out of the developing device after the powder developer has been removed from the air by the first developer removing device.

11. An image forming apparatus comprising:

a photoreceptor for forming an electrostatic latent image thereon;

a developing device for visualizing, by using powder developer, the electrostatic latent image formed on the photoreceptor;

a transfer device for transferring, onto a recording material, an image visualized by the developing device;

a fixing device for fixing the powder developer on the recording material by heating and melting the powder developer; and an isolating member for isolating a first space from a second space, the first space being a space in which the powder developer which is not yet fixed on the recording material is present, and the second space being a space outside the isolating member, wherein the isolating member has (i) a outlet hole for letting dew-forming moisture out of the first space into the second space, and (ii) above the fixing device, a region being tilted with respect to a plane perpendicular to a vertical direction so that the dew formed on the region will be lead to the outlet hole.

12. The image forming apparatus as set forth in claim 11, comprising:

a second developer removing device provided to the outlet hole, the second developer removing device allowing moisture from the isolating member to pass therethrough, but removing the powder developer.

* * * * *